US005715499A

United States Patent [19]

Yamazaki et al.

[11] Patent Number: 5,715,499

[45] Date of Patent: Feb. 3, 1998

[54] CONTACT CHARGER HAVING AN OSCILLATING VOLTAGE FOR CHARGING A PHOTOSENSITIVE MEMBER

[75] Inventors: Michihito Yamazaki, Tokyo; Hiroki Kisu, Fujisawa; Erika Asano, Tokyo; Eiji Funabashi, Fujinomachi; Hiroaki Ogata, Tokyo; Kazumi Yamauchi, Fujimi, all of Japan

[73] Assignee: Canon Kabushiki Kaisha, Tokyo, Japan

[21] Appl. No.: 811,620

[22] Filed: Mar. 5, 1997

Related U.S. Application Data

[63] Continuation of Ser. No. 438,974, May 11, 1995, abandoned.

[30] Foreign Application Priority Data

May 11, 1994 [JP] Japan ..... 6-121980

[51] Int. Cl.[6] ..... G03G 15/02

[52] U.S. Cl. ..... 399/50; 361/220; 399/169; 399/174

[58] Field of Search ..... 399/50, 168, 169, 399/174; 361/220, 221, 223, 225

[56] References Cited

U.S. PATENT DOCUMENTS

| | | | |
|---|---|---|---|
| 4,636,060 | 1/1987 | De Schamphelaere et al. | 355/246 |
| 4,970,557 | 11/1990 | Masuda et al. | 355/246 |
| 5,060,017 | 10/1991 | Ueda | 355/221 |
| 5,146,280 | 9/1992 | Kisu | 355/219 |
| 5,146,281 | 9/1992 | Kisu | 355/219 |
| 5,164,779 | 11/1992 | Araya et al. | 355/219 |
| 5,177,534 | 1/1993 | Kisu et al. | 355/219 |
| 5,187,535 | 2/1993 | Tajima | 355/326 |
| 5,282,007 | 1/1994 | Oshiumi | 355/296 |
| 5,416,563 | 5/1995 | Magde, Jr. | 355/208 |
| 5,438,397 | 8/1995 | Okano et al. | 355/269 |

FOREIGN PATENT DOCUMENTS 63-149669 6/1988 Japan .

*Primary Examiner*—William J. Royer

*Attorney, Agent, or Firm*—Fitzpatrick, Cella, Harper & Scinto

[57] ABSTRACT

An image forming apparatus includes an image bearing member; an image forming device for forming an image on the image bearing member, the image forming device being provided with a charging member which is disposed in contact or proximity with the image bearing member to electrically charge the image bearing member; wherein the charging member is supplied with an oscillating voltage, and there is provided a voltage set period in which a peak-to-peak voltage of the oscillating voltage is higher in a period in which the image is not formed on the image bearing member than in a period in which the image is formed on the image bearing member.

15 Claims, 6 Drawing Sheets

O(o.o)

CONTACT CHARGER HAVING AN OSCILLATING VOLTAGE FOR CHARGING A PHOTOSENSITIVE MEMBER

This application is a continuation, of application Ser. No. 08/438,974 filed May 11, 1995, now abandoned.

FIELD OF THE INVENTION AND RELATED ART

The present invention relates to an image forming apparatus provided with a charging member for charging an image bearing member such as a photosensitive member or dielectric material heretofore, in an image forming apparatus such as an electrophotographic apparatus (copying machine, laser beam printer or the like) or an electrostatic recording apparatus, as for means for charging (including discharging) the member to be charged such as a photosensitive member or dielectric material or another image bearing member, a corona discharging device in which a wire is supplied with a high voltage to produce corona discharge, and the member to be charged is exposed to the corona discharge (non-contact type), has been widely used. Recently, however, a contact type charging device (charging device supplied with a voltage), that is, a charging device contacted to the member to be charged and supplied with a voltage, has been developed.

The contact type charging is advantageous over the corona discharging device in that the voltage applied to charge the member to be charged to a desired potential can be reduced; that the amount of ozone produced by the charging is so small that the ozone filter is not necessary; the structure of the air discharging system is simplified therefore; the maintenance is not required; and the structure is simple.

Therefore, it is noted as means replaceable with the corona discharge as a means for charging the photosensitive member and the dielectric material in an image forming apparatus such as the electrophotographic apparatus or electrostatic recording apparatus.

As to such a contact type charging method and apparatus, Japanese Laid-Open Patent Application No. 149669/1988 under the name of the assignee of this application has proposed that a DC voltage biased with an oscillating voltage is applied to an electroconductive member (contact charging member), and the conductive member is contacted to the member to be charged (AC application type). Particularly the oscillating voltage component preferably has a peak-to-peak voltage which is not less than twice as high as the charge starting voltage (the voltage at which the charging of the member to be charged starts when only the DC voltage is applied to the charging member and it is gradually increased) for the member to be charged, since the uniform charging (discharging) is possible.

In place of con%acting the charging member to the member to be charged, it is known that the charging member is disposed in proximity with the member to be charged. Such a contact type or proximity type charging involves a drawback that in proper discharging or abnormal discharging tends to occur when foreign matter such as toner or paper dust exists adjacent the contact or proximity portion between the charging member and the member to be charged. This drawback results in unstable due to the deposition of the foreign matter adjacent the contact portion or proximity portion.

Particularly when the charging member is in a form of compact blade or sheet, the foreign matter tends to accumulate on the charging surface because the charging surface of the charging member is fixed.

When the oscillating voltage component is applied to the charging member, the charge potential changes at a period equal to the movement speed of the member surface of the member to be charged divided by the frequency of the oscillating voltage, and therefore, when an image having a periodicity with respect to the movement direction of the surface of the photosensitive member (the member to be charged), is produced, the spatial frequency of the charge potential and the spatial frequency of the latent image potential interfere with each other depending on the period with the result of beating, thus disturbing the output image (moire image).

SUMMARY OF THE INVENTION

Accordingly, it is a principal object of the present invention to provide an image forming apparatus in which deposition of foreign matter is prevented at the charging surface of the charging member.

It is another object of the present invention to provide an image forming apparatus in which the foreign matter can be removed from the charging surface of the charging member.

It is a further object of the present invention to provide an image forming apparatus in which the abnormal discharging adjacent the contact portion or proximity portion between the charging member and the member to be charged.

It is a further object of the present invention to provide an image forming apparatus in which the moire is not produced in the image.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Embodiment 1

Figure 1:
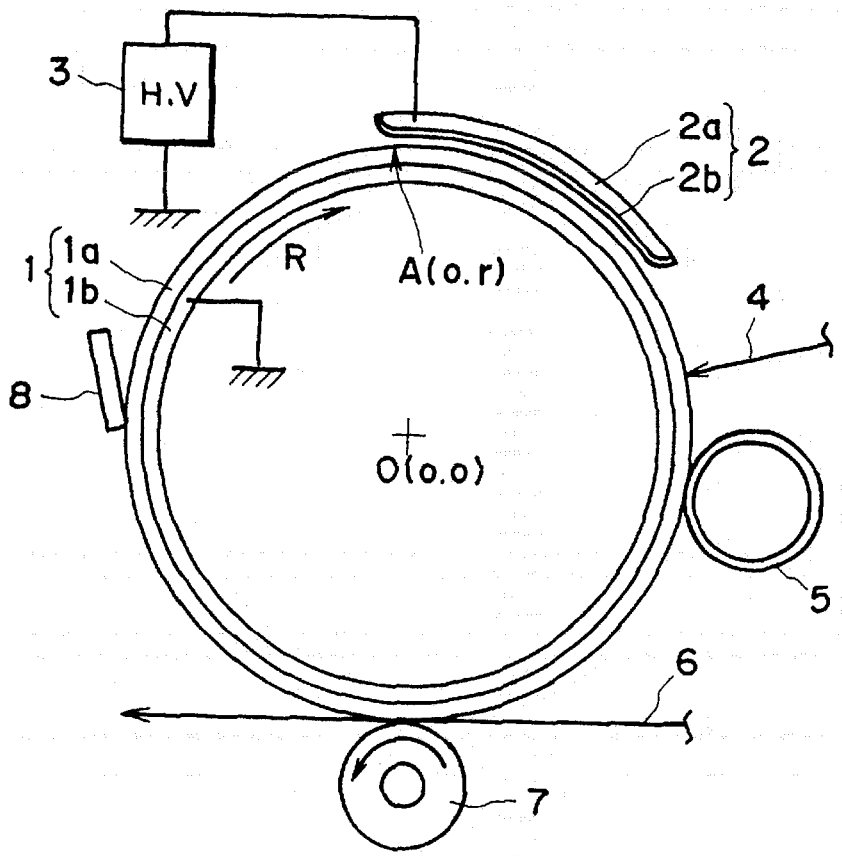
FIG. 1 schematically shows an arrangement of a major part of an image forming apparatus.
Figure 2:
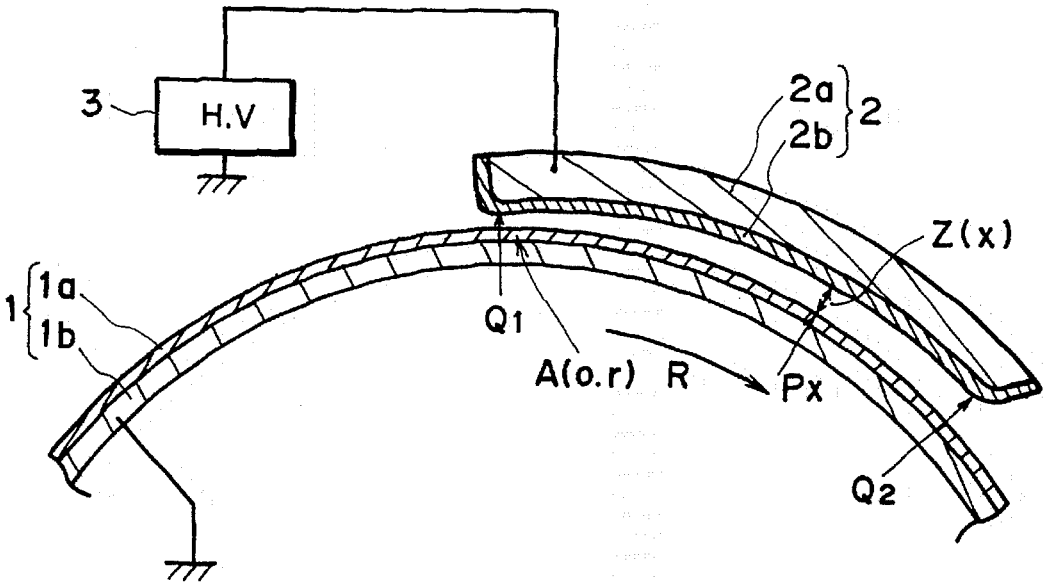
FIG. 2 is an enlarged view of a major part of a charging device.

FIG. 1 is a schematic view of an apparatus according to Embodiment 1. FIG. 2 is an enlarged view of a major part. In this embodiment, the image forming apparatus is in the form of a laser beam printer of an electrophotographic type.

The photosensitive drum in the form of an image bearing member (member to be charged) comprises a drum base 1*b* of aluminum end a photosensitive layer in the form of an organic photoconductor (OPC) layer 1*a*. It has a radius (r) of 15 mm. It is rotated at a peripheral speed of 100 mm/sec in the clockwise direction (R) about a shaft which is at a point of origin (0, 0).

A charging member 2 comprises an electrode member 2*a* and a high resistance layer 2*b*. The electrode member 2*a* comprises metal, electroconductive plastic material, electroconductive rubber or the like, and the high resistance layer 2*b* is a thin layer of high resistance material polypropylene in which carbon and titanium oxide are dispersed. It has a film thickness of 40 μm and a volume resistivity of $10^{12}$ ohm.cm.

The charging member 2 is fixed such that its high resistance layer 2*b* side is faced to the photosensitive drum 1 surface, and the surface is closest at a point A (0, r) on the photosensitive drum, and the gap therebetween is approx. 70 μm. The gap is preferably not more than 1 mm.

A concave surface of the charging member 2 is faced to the photosensitive drum 1. At the opposite longitudinal ends of the closest region and at the opposite end portions at the position downstream thereof, unshown spacers are provided so as to be contacted to the non-image portion of the photosensitive drum, by which the air gap is formed relative to the photosensitive drum.

Designated by a reference numeral 3 is a voltage application source for the charging member 2. The voltage application source 3 applies to the electrode 2*a* of the charging member the voltage (Vac+Vdc), wherein Vdc is a DC component and Vac is an oscillating component (AC component) having a peak-to-peak voltage Vpp which is higher than twice the charge starting voltage (the voltage at which the charging of the photosensitive drum starts if only the DC voltage is applied to the charging member). By doing so, the outer peripheral surface of the photosensitive drum 1 which is rotated is uniformly charged. On the other hand, time series electric digital pixel signal of intended image (print) information is supplied to the laser scanner (not shown) from host apparatus (not shown) such as a computer, wordprocessor or image reader. A laser beam 4 imagewisely modulated (intensity modulation) at a constant printing density D (dpi) corresponding to the input pixel signal from the laser scanner controlled by a controller. Thus, the line scanning (main scanning in the direction of the generating line of the drum) by the output laser beam 4 is effected to the charged surface of the photosensitive drum 1, so that the intended image information is written by which an electrostatic latent image corresponding to the intended image information is formed on the rotating photosensitive drum 1 surface.

The latent image is visualized into a toner image by reverse development by developing sleeve 5 of a developing device. A toner image is transferred onto a recording material (transfer material) supplied at the predetermined timing to an image transfer nip (transfer position) formed between the photosensitive drum 1 and the transfer roller 7, from an unshown sheet feeding station. Since the reverse development is used, the polarity of the charging bias applied to the charging member and the polarity of the charged toner are the same.

The recording material 6 having the transferred toner image is separated from the surface of the photosensitive drum 1 and is fed to an unshown image fixing means, where the toner image is fixed on the recording material. The material is outputted as a print. The surface of the rotating photosensitive drum 1 after the separation of the transfer material is cleaned by a cleaning device (cleaner) more particularly the cleaning blade 8 so that the residual foreign matter such as residual toner or the like is removed so as to be prepared for the repeated image forming operation.

(1) Switching of applied oscillating voltage

When the discharging surface of the charging member is faced to the image area of the photosensitive drum 1, the electrode member 2*a* of the electrode 2 is supplied from the voltage 3 with the following voltage:

AC component Vpp: 1800 V

Frequency f: 200 Hz

DC component: −600 V

Waveform: sine wave

The image forming area means an area of the image bearing member in which the latent image can be formed when the area reaches the latent image forming position (image exposure position) (the area in which the latent image can be given image formation). Therefore, in the period of the image formation on the photosensitive drum, the oscillating voltage is applied to the charging member.

The charging member 2 has a fixed discharging surface, and therefore, the discharging surface tends to be charged up by accumulation of the electric charge. Particularly when the scattered toner or paper dust or the like are deposited on the discharging surface, and when the humidity of the ambience is high, the deposited matter has low resistance due to moisture absorption, and therefore, they function as nucleus of discharging with the result of abnormal discharging.

In addition, in the case of the concave type charger, the time period in which it is faced to the member to be charged is longer than in the case of flat plates, and this also promotes the abnormal discharging.

In consideration of the above, in this embodiment, a voltage, which will hereinafter be called "cleaning bias voltage", for transferring the contamination such as the scattered toner or the paper dust to the photosensitive drum 1 is applied to the charging member 2 at the timing in which the charging surface is faced to the non-image formation area of the photosensitive drum (image bearing member). Thus, the cleaning bias is supplied to the charging member when the charging surface of the charging member is faced to the area of the photosensitive drum 1 not related to the image formation.

In this embodiment, in order to repel the paper dust and the developer powder comprising negatively chargeable toner particles and negatively chargeable silica particles, the following cleaning bias voltage is applied during the warm-up period, pre-rotation period, intervals between adjacent sheets (recording materials) and the post-rotation, periods:

AC voltage: 4 KV

DC voltage: −2 KV

Waveform: sine wave

Here, the warm-up rotation period means the period in which the drum is rotated from the time of actuation of the main switch of the printer to the time at which the fixing device reaches the stand-by temperature. The pre-rotation period is the period between the time of application of the image formation signal from the outside of the printer to the start of the charging for the image information for the photosensitive drum. The sheet interval period means the period in which the non-image formation area between an image formation area and the subsequent image formation area passes through the charging position of the charging member when a plurality of images are continuously formed on the photosensitive drum. The post-rotation period is the period after the completion of the image formation charging on the photosensitive drum, in which the photosensitive drum is rotated.

Of the peak-to-peak voltage, frequency and the DC component of the oscillating voltage component, at least one of the peak-to-peak voltage and the frequency is different between the cleaning bias and the image formation charge voltage, preferably.

Figure 3:
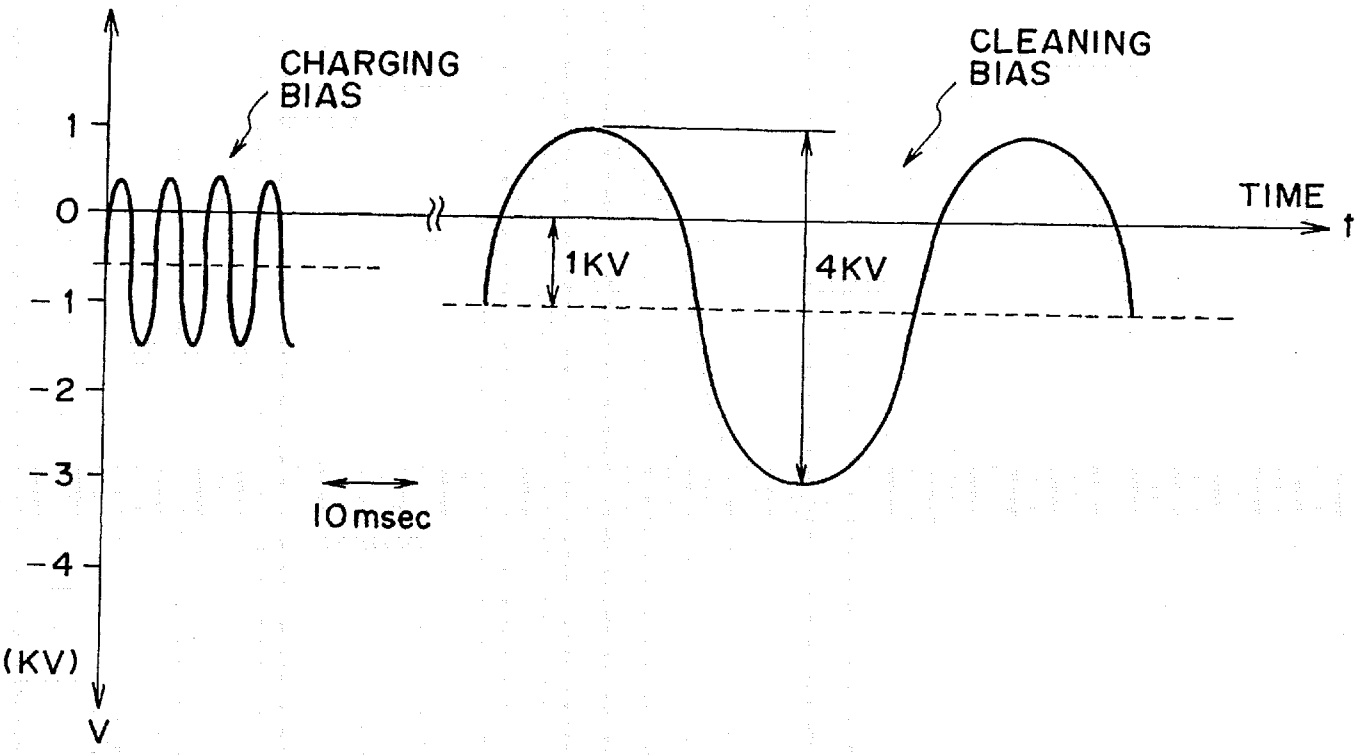
FIG. 3 shows a waveform of a charging bias and a cleaning bias voltages.

FIG. 3 shows the image formation charge voltage which is applied to the charging member when the discharging surface of the charging member is faced to the image formation area of the photosensitive drum 1, and a waveform of the cleaning bias voltage which is applied to the charging member when the charging surface is faced to the non-image area of the photosensitive drum 1.

The DC component of the cleaning bias voltage is −2 KV because the voltage has been found effective to repel the toner by enhancing the negative component as compared with that of the image formation charging voltage. Thus, the DC component of the cleaning bias is preferably away from the image formation charging voltage toward the same polarity as the toner charging polarity. The peak-to-peak voltage Vpp of the cleaning bias voltage is 4 KV because the amplitude of the cleaning bias has been found effective in the contamination removing function if it is larger than that of the image formation charging voltage. On the other hand, the peak-to-peak voltage of the image formation charge voltage is preferably small from the standpoint of prevention of the deterioration of the photosensitive drum.

The frequency of the cleaning bias is 20 Hz, because the frequency lower than that of the image formation charge voltage has been found to be effective in the removal of the contamination of the discharging surface. The reason is considered as follows; if the frequency of the cleaning bias voltage is too high, the motion of the foreign matter (contamination) is unable to follow the change of the electric field. On the other hand, the frequency of the image formation charge voltage is preferably large from the standpoint of prevention moire.

Figure 4:
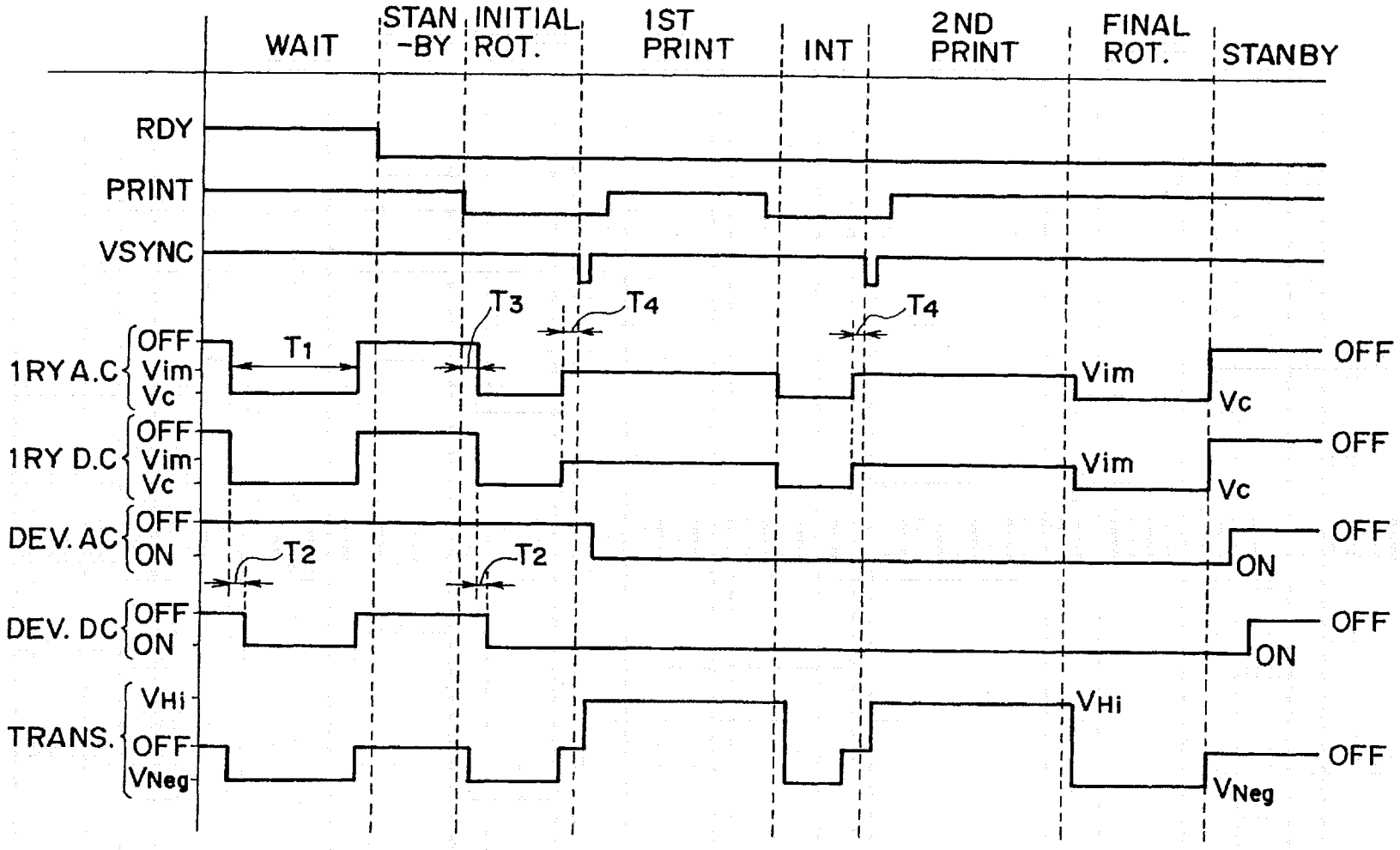
FIG. 4 is a timing chart of the cleaning bias voltage applied to the charging member.

FIG. 4 shows a timing chart of the application of the cleaning bias voltage. It shows on and off states of the primary charger, developing device and transfer high voltage application when two continuous printing is effected for a transfer material.

In the Figure, Vim indicates the state in which the bias voltage is applied to charge the image formation area of the photosensitive drum, and Vc shows the state in which the cleaning bias voltage is applied.

VHi indicates the state in which the bias voltage is applied to the transfer roller 7 to transfer the toner image from the photosensitive drum 1 onto the transfer material (sheet) from the photosensitive drum 1. VNeg indicates states in which the various voltages are applied to transfer the contamination on the transfer roller 7 onto the photosensitive drum 1.

T1 indicates the time period in which the contaminations of the charging material 2 and the transfer roller 7 are to be transferred back onto the photosensitive drum 1 during the warm-up rotation. In this embodiment, it is 630 msec corresponding to two rotations of the transfer roller 7 having the diameter of 20 mm in this embodiment.

T2 is the time period from the start of the cleaning bias voltage application to the charging member to arrival of point of the photosensitive drum 1 to the developing zone from the charging position, and is 30 msec in this embodiment.

T3 indicates a rising period of an unshown main motor, and is 200 msec in this embodiment.

T4 is a time period from the image formation charging start to the image exposure position from the charging position of the drum, and is 15 msec.

In the case that the cleaning bias voltage is not applied to the charging member 2, if the apparatus is left through one night after as few as 100 printings after high temperature and high humidity ambience, the improper discharge occurred upon the actuation of the main switch on the next day. On the other hand, when the cleaning bias voltage is applied during the warm-up period, the pre-rotation period, the sheet interval period and the post-rotation period, the improper charging or abnormal discharging attributable to the contamination of the charging surface did not occur even if 5000 sheets are printed, upon reactuation of the main switch even under high temperature and high humidity condition.

(2) Moire prevention

By using the concave surface of the discharging surface of the charging member 2, the production of the moire is suppressed. Particularly, the discharging surface is preferably provided with the same radius of curvature which is substantially equal to the curvature of the drum 1.

In this embodiment, the air gap is formed relative to the surface of the photosensitive member, using a concave surface having a radius of curvature of 17 mm in the region Q1–Q2 in FIG. 2.

Figure 5:
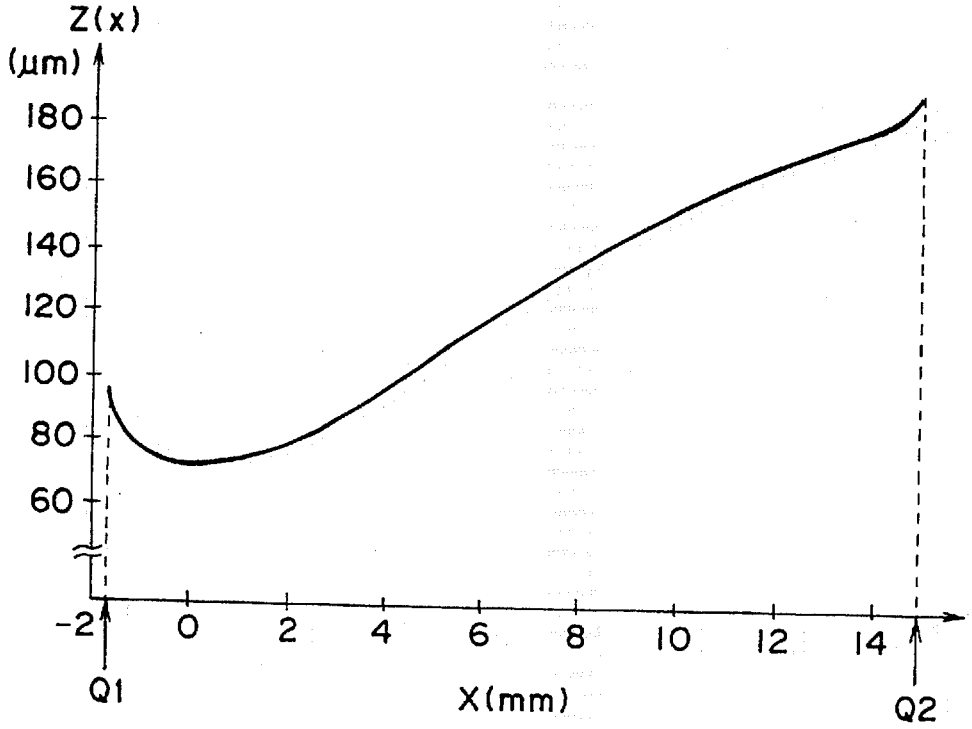
FIG. 5 is a graph showing a distance between the surface of the photosensitive member and the charging member surface.

If a given point on the surface of photosensitive member surface is Px, a length of arc APx is X, a distance (gap) between the charging member 2 and Px is Z(x), Z(x) is so related with X as shown in FIG. 5. The following image formation charge voltage is applied to the charging member:

Vpp of the AC component: 2200 V

Frequency: 200 Hz

DC component: −600 V

From the Paschen's law, the discharging condition can be calculated, and it is understood that the discharging to the surface of the photosensitive drum occurs in the region X1–X2. In this embodiment, the discharging surface of the charging member is provided with the concave surface, the discharging width is approx 17 mm which is as large as almost 20 times that in the case of the roller type charging member, and in addition, in the discharging region, Z(x) substantially linearly increases relative to the movement distance of the photosensitive member as shown in FIG. 5. Therefore, the potential distribution when the negative maximum level of the oscillating voltage is applied, is such that the potential gradually decreases from the maximum potential portion toward the downstream in accordance with the distance change between the charging member and the photosensitive member, as shown in FIG. 6.

Figure 6:
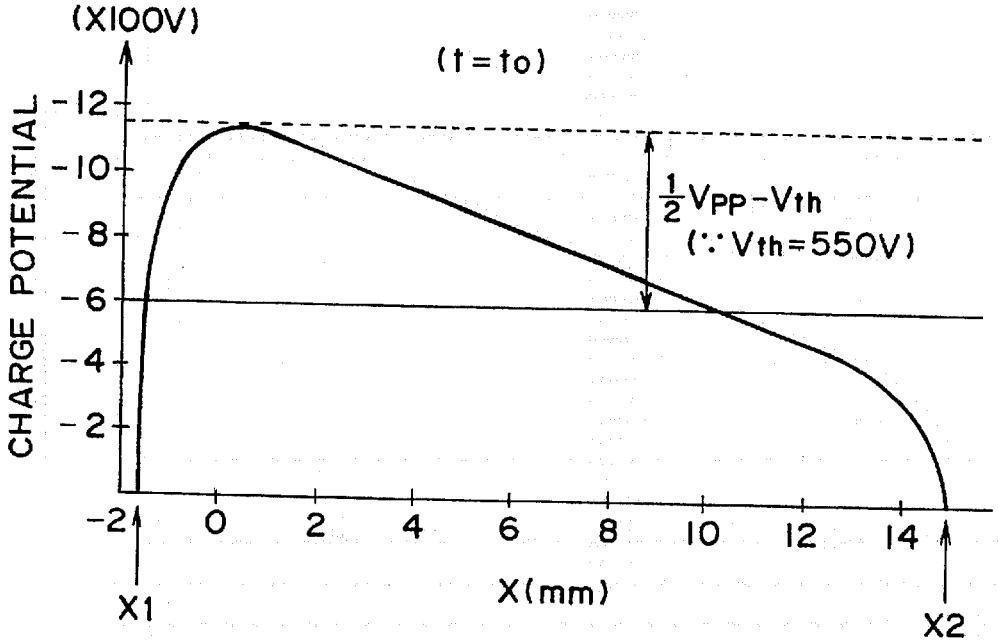
FIG. 6 is a graph showing a potential distribution provided by one discharging action.

The amplitude of the charge potential change contributable to the moire, is determined on the basis of the frequency of the oscillation voltage, the movement speed of the surface of the photosensitive member and the charge potential distribution shown in FIG. 6. For the sake of simplicity of description, the charging when the maximum of the oscillating voltage is applied.

FIG. 6 shows the time period t=t0 which is the time period of the charging action.

Figure 7:
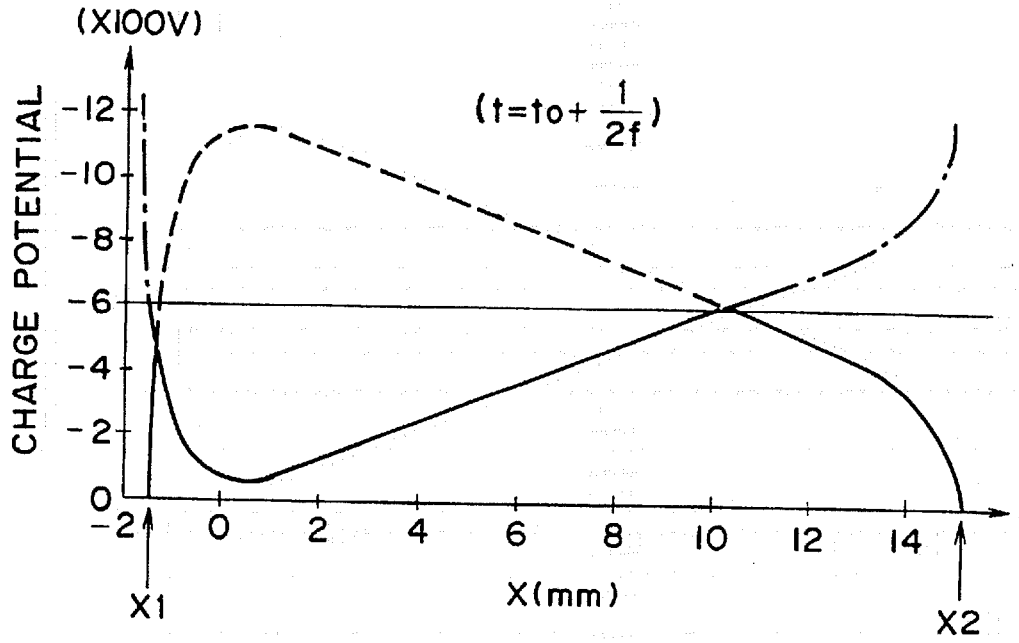
FIG. 7 is a graph showing a charge potential distribution at the point of time when the time corresponding to one half the period of the oscillating bias voltage elapses.

FIG. 7 illustrates the charge potential at the point of time when one half the period of the oscillating bias voltage elapses from t=t0 (½f=1/600 (sec)).

At the point of time of t=t0+½f, the charging member 2 is supplied with the positive side maximum level of the oscillating bias voltage, and therefore, the direction of the electric field is reversed relative to the center corresponding to the DC bias voltage level, and therefore, the distribution of the charge potential of the photosensitive member is as shown in FIG. 7 by solid line.

Figure 8:
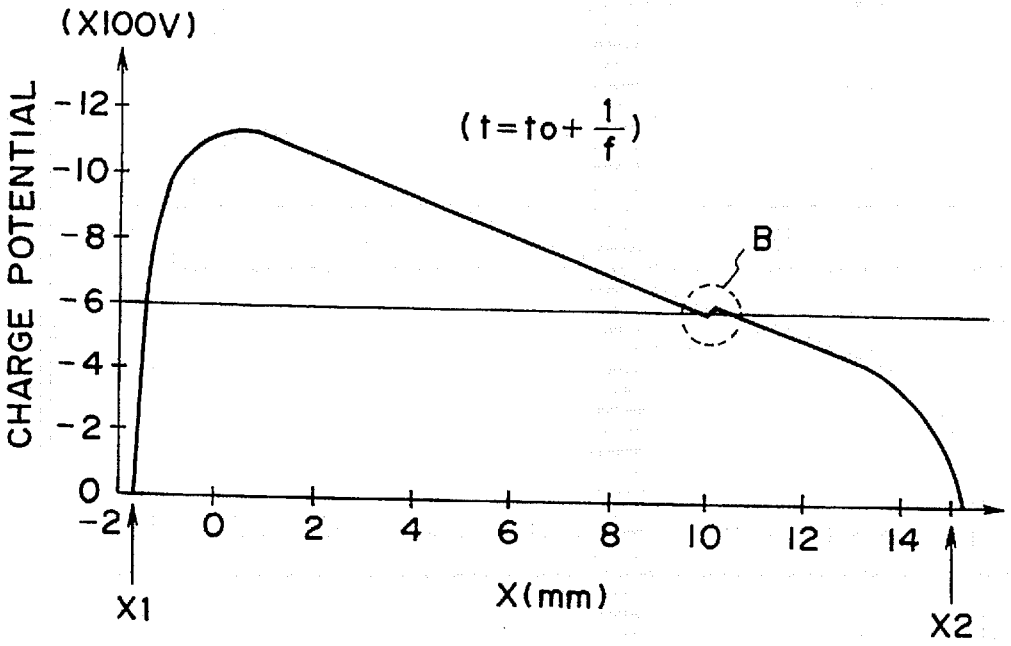
FIG. 8 illustrates a charge potential distribution at the time when one period of the oscillating bias voltage elapses.

FIG. 8 shows the charge potential distribution at the time of t=t0=1/f. The saw teeth potential change in the region B in the Figure results from the charging using the oscillating electric field. By reducing the amplitude, the moire can be made less remarkable in this embodiment, the calculated amplitude is not more than 40 V. The potential distribution shown in FIG. 6 can be changed by changing the radius of curvature of the discharging surface of the charging member and the length thereof as is well-known.

Actually, the images have been produced by the apparatus of this embodiment, the moire image is not at all recognized on a halftone image at 600 dpi, and satisfactory images are produced without memory in the photosensitive drum.

Thus, according to this embodiment, the contamination deposited on the discharging surface of the fixed charging member which is compact and less costly, can be transferred positively to the image bearing member, and therefore, the improper charging or abnormal discharging which tends to occur under the high temperature and high humidity conditions, can be suppressed, so that stable charging is possible for a long period without production of moire.

In this embodiment, the charging member 2 is out of contact with the photosensitive drum 1 (image bearing member) as the member to be charged, but may be partly contacted, if the discharging condition of Paschen's law is satisfied between the faced surfaces of the charging member and the member to be charged irrespective of the contact or non-contact therebetween.

The image bearing member as the member to be charged has been described as a drum-like photosensitive member (cylindrical) having a convex shape, but flat photosensitive member such as a belt is usable. In this case, the charging area of the photosensitive member can be maintained flat.

Embodiment 2 will be described.

The materials, the dimensions, the volume resistivities, the thicknesses, the bias voltage levels of the constituent elements are nearly examples, and the present invention is not limited to these.

Figure 9:
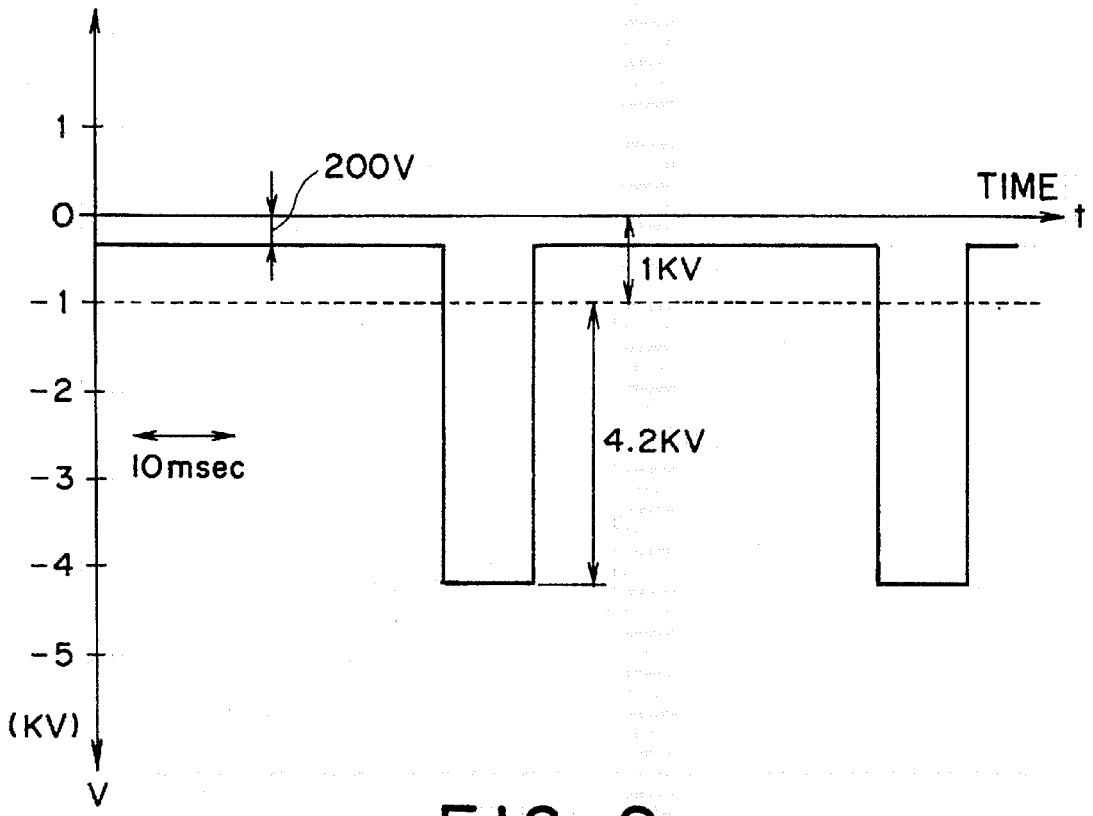
FIG. 9 illustrates a waveform of a cleaning bias in the device of Embodiment 2.

Embodiment 2 (FIG. 9)

In this embodiment, the duty ratio of the cleaning bias voltage in the apparatus of Embodiment 1 is changed to enhance the electric field intensity effective to repel the contamination of the discharging surface.

The structures of the charging member and the other parts of the device are the same as shown in FIGS. 1 and 2.

The level of the image formation charge potential applied to the charging member and the timing sequence (FIG. 4) of the entire apparatus are the same as in Embodiment 1.

In this embodiment, the following cleaning bias voltage is applied to the charging member:

AC component Vpp: 4 KV

Frequency: 200 Hz

Duty ratio: 20:80

DC component: −1 KV

Waveform: rectangular wave

The waveform of the bias voltage is shown in FIG. 9.

The image formation apparatus of this embodiment uses the developer comprising negatively chargeable toner particles and negatively chargeable silica particles. Accordingly, by changing the duty ratio of the waveform of the cleaning bias voltage, the intensity of the electric field effective to repel the foreign matter out of the discharging surface, the foreign matter having been charged to the negative polarity, is increased, and therefore, the amount of the toner deposited on the discharging surface of the charging member 2 can be further reduced as compared with Embodiment 1.

Actually, by using the charging member of this embodiment, the improper charging and abnormal discharging attributable to the contamination of the discharging surface did not appear on the image up to 10,000 sheets processing. As described, the contamination of the discharging surface by the toner and the paper dust can be reduced by using the charging member. Particularly, under the high temperature and high humidity condition, the improper charging and the abnormal discharging tending to occur upon reduction of the resistance of the contamination can be suppressed.

The charging member or the charging device of Embodiment 1 or 2 is usable with a process cartridge for an image forming apparatus in which charging means is used for the image bearing member. The process cartridge contains as a unit at least two of charging means, photosensitive member, developing means and the cleaning means, and is detachably mountable to a main assembly of the image forming apparatus. By unifying as a cartridge, consumables represented by the photosensitive member and the developer, substantially maintenance free image forming apparatus can be provided, because the cartridge can be easily replaced by a user.

Figure 10:
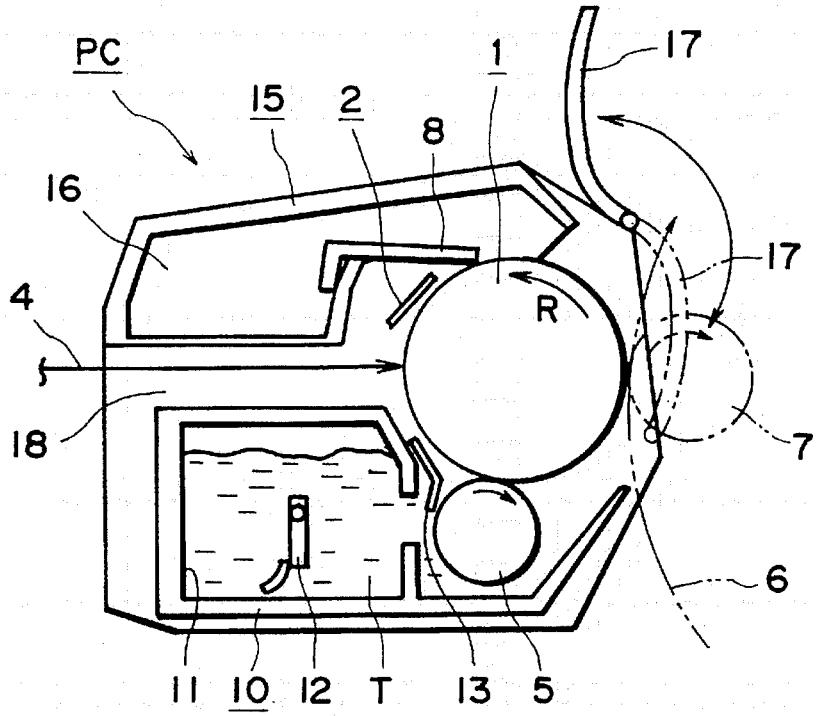
FIG. 10 schematically shows an arrangement of a major part of a process cartridge.

As shown in FIG. 10, the process cartridge PC of this embodiment contains a rotatable drum type electrophotographic photosensitive member 1 as the image bearing member, and the charging member 2, the developing device 10 and the cleaning 15 (four process means). The developing device 10 comprises a developing sleeve 5, a toner container 11 for containing developer (toner) T, a toner stirring member 12 in the container 11 for stirring and feeding the toner to the developing sleeve. As a developing blade 13 is effective to apply the toner T on the developing sleeve 5 with uniform thickness.

The cleaning 15 comprises a cleaning blade 8, a toner container for containing the toner removed by the cleaning blade 8.

Designated by a reference numeral 17 is a drum shutter of the process cartridge and is movable between an open position indicated by the solid line and the closed position indicated by the chain line. When the process cartridge is removed from the main assembly (not shown) of the image forming apparatus, it takes the closing position to protect the exposed portion of the photosensitive drum 1, thus protecting the surface of the photosensitive drum. When the process cartridge is mounted to the image forming apparatus, the shutter 17 is opened to the open position, or in the process of the mounting of the process cartridge, the shutter 17 is automatically opened, and when the process cartridge is mounted in place, the exposed portion of the drum 1 is press-contacted to the transfer roller 7 in the main assembly of the image forming apparatus the voltage source for applying the voltage to the charging member is provided in the main assembly. When the process cartridge is mounted, the mechanical and electrical coupling is established between the process cartridge and the image forming apparatus main assembly to permit driving of the photosensitive drum 1, the developing sleeve 5, the stirring member 12 or the like of the process cartridge by the driving mechanism of the main assembly, and in addition, to permit application of the charging bias voltage to the charging member in the process cartridge, the application of the developing bias voltage to the developing sleeve 5 and the like from the electric circuit of the main assembly. Thus, the image forming operation is enabled.

Designated by 18 is an exposure passage between the cleaner 15 and the developing device 10 of the process cartridge, which functions to pass the laser beam 4 from a laser scanner (not shown) of the main assembly into the process cartridge to the surface of the photosensitive drum 1, thus permitting scanning exposure of the photosensitive drum 1.

According to the charging member of this embodiment, the charging is possible with less potential change by the oscillation bias voltage application.

In addition, the latent image formation of the image forming apparatus in this embodiment, is not limited to the method in which the photosensitive drum is scanned with an intensity-modulated laser beam by a polygonal scanner (line scanning), but it is applicable to a known method in which LED head, an optical system comprising a liquid crystal shutter and light source, or the like, are usable.

Furthermore, the image bearing member is not limited to the photosensitive drum, but insulative member is usable. In this case, pin electrodes are disposed at a downstream side of the charging member with respect to the movement direction of the surface of the image bearing member in such a manner that they are arranged in the longitudinal direction of the image bearing member (multi-stylus recording head). The latent image is formed after charging.

The developing system is not limited to reverse development, but the same advantageous effect can be provided in the case of regular development.

The oscillating voltage comprises an oscillating component (AC component) or it comprises the AC component and a DC component (corresponding to the target charge potential). The waveform of the AC component is sine wave, rectangular wave, triangular wave or the like. The oscillating voltage may be provided by periodically rendering on and off the DC voltage source (rectangular wave voltage).

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

image forming means for forming an image on said image bearing member, said image forming means being provided with a charging member which is disposed in contact or proximity with said image bearing member to electrically charge said image bearing member at a charging position;

wherein said charging member is supplied with an oscillating voltage, and wherein there is provided a voltage set period in which a peak-to-peak voltage of the oscillating voltage is higher in a period in which an area of said image bearing member on which no image is to be formed is in said charging position than in a period in which an area of said image bearing member on which an image is to be formed is in said charging position.

2. An apparatus according to claim 1, wherein a frequency of the oscillating voltage is smaller in the voltage set period than in the period in which an area of said image bearing member on which an image is to be formed is in said charging position.

3. An apparatus according to claim 1 or 2, wherein said image forming means includes developing means for developing said image bearing member with toner, and a DC component of the oscillating voltage in the voltage set period is more remote toward the same polarity of charge polarity of the toner than in the period in which an area of said image bearing member on which an image is to be formed is in said charging position.

4. An apparatus according to claim 1 or 2, wherein said image forming means includes developing means for developing said image bearing member with toner having a charge polarity which is the same as a charge polarity of said charging member, and wherein a DC component of the oscillating voltage is higher in the voltage set period than in the period in which an area of said image bearing member on which an image is to be formed is in said charging position.

5. An apparatus according to claim 1 or 2, wherein said charging member is fixed irrespective of movement of said image bearing member.

6. An apparatus according to claim 4, wherein said charging member is fixed irrespective of movement of said image bearing member.

7. An apparatus according to claim 5, wherein said image bearing member is in the form of a drum, and said charging member has substantially the same radius of curvature as the radius of curvature of said charging member at a portion faced to said image bearing member.

8. An apparatus according to claim 1 or 2, wherein said image bearing member is an electrophotographic photosensitive member.

9. An image forming apparatus comprising:

an image bearing member;

image forming means for forming an image on said image bearing member, said image forming means being provided with a charging member which is disposed in contact or proximity with said image bearing member to electrically charge said image bearing member at a charging position;

wherein said charging member is supplied with an oscillating voltage, and wherein there is provided a voltage set period in which a frequency of the oscillating voltage is lower in a period in which an area of said image bearing member on which no image is to be formed is in said charging position than in a period in which an area of said image bearing member on which an image is to be formed is in said charging position.

10. An apparatus according to claim 9, wherein said image forming means includes developing means for developing said image bearing member with toner, and a DC component of the oscillating voltage in the voltage set period is more remote toward the same polarity of charge polarity of the toner than in the period in which an area of said image bearing member on which an image is to be formed is in said charging position.

11. An apparatus according to claim 9, wherein said image forming means includes developing means for developing said image bearing member with toner having a charge polarity which is the same as a charge polarity of said charging member, and wherein a DC component of the oscillating voltage is higher in the voltage set period than in the period in which an area of said image bearing member on which an image is to be formed is in said charging position.

12. An apparatus according to claim 9, 10 or 11, wherein said charging member is fixed irrespective of movement of said image bearing member.

13. An apparatus according to claim 12, wherein said image bearing member is in the form of a drum, and said charging member has substantially the same radius of curvature as the radius of curvature of said charging member at a portion faced to said image bearing member.

14. An apparatus according to claim 9, wherein said image bearing member is an electrophotographic photosensitive member.

15. An apparatus according to claim 1 or 9, wherein said charging member is spaced from said image bearing member with a distance not more than 1 mm.

* * * * *